US005339596A

United States Patent [19]

Cohen

[11] Patent Number: 5,339,596

[45] Date of Patent: Aug. 23, 1994

[54] TONER CARTRIDGE RECHARGING TOOL

[76] Inventor: Zev B. Cohen, 5624 Oak Pl., Bethesda, Md. 20814

[21] Appl. No.: 971,211

[22] Filed: Nov. 4, 1992

[51] Int. Cl.[5] ..... B65B 61/18

[52] U.S. Cl. ..... 53/136.3; 53/133.3; 156/423; 156/579

[58] Field of Search ..... 53/133.3, 133.5, 133.7, 53/136.3, 373.2, 390; 156/293, 423, 475, 492, 579

[56] References Cited

U.S. PATENT DOCUMENTS

| | | | |
|---|---|---|---|
| 1,731,600 | 10/1929 | Turner | 53/133.3 |
| 1,956,209 | 4/1934 | Booth | 53/133.3 X |
| 2,986,860 | 6/1961 | Salzwedel | 53/136.3 X |
| 3,304,218 | 2/1967 | Challman | 156/579 X |
| 4,065,335 | 12/1977 | Pollack | 156/69 X |
| 4,234,375 | 11/1980 | Ciccavello | 156/579 X |
| 4,279,065 | 7/1981 | Serney . | |
| 4,599,851 | 7/1986 | Williams . | |
| 4,831,810 | 5/1989 | Engel | 53/390 |
| 5,142,845 | 9/1992 | MaClauchlan . | |

*Primary Examiner*—John Sipos
*Assistant Examiner*—Daniel Moon
*Attorney, Agent, or Firm*—Richard C. Litman

[57] ABSTRACT

A toner cartridge recharging tool has a base that includes a workholder to receive and prevent significant axial movement of a toner cartridge. There is also a guide slot mount and a swivel arm mount attached to the base. The toner cartridge is inserted between a pair of receiving members and the adhesive strip seal is wrapped over the insertion tongue. The tongue guide shoe and the tongue itself are fit into the two guide slots and the swivel arms are engaged with a protrusion on the tongue guide shoe. Movement of the arm thus forces the insertion tongue into the thin slit in the side of the toner cartridge and, when the movement of the arm or arms is reversed, the adhesive strip seal is left in place.

8 Claims, 4 Drawing Sheets

TONER CARTRIDGE RECHARGING TOOL

BACKGROUND OF THE INVENTION

1. Field of the Invention

The present invention relates to reloading toner cartridges so as to make them reusable as new. One particular problem associated with reloading cartridges is to properly seal the toner storage chamber in order to prevent toner spillage during handling and transportation. With the advent and popularity of laser printers there has arisen a large demand for toner to supply these printers. Most printer manufacturers have chosen to supply replacement toner in the form of complex toner cartridges which are custom fitted to their particular brand of printer. These cartridges are generally complex and expensive moldings often carrying integral parts of the printer mechanism as a part of their embodiment. The theory was that it would be easy to sell these expensive toner cartridges to users because that was the only way they could get their expensive printer to print. These "throwaway cartridges" represented a significant waste of labor and energy not to mention the additional burden placed on our landfill sites with more non-biodegradable waste. The integral printer parts included with some throwaway cartridges commonly include the finely machined and finished transfer drum along with its bearings and drive gear. The wear and tear encountered by these peripheral parts rarely justifies their replacement upon every toner exhaustion. Since the cartridges were designed to be throwaway in nature there has been no forethought given to the ease with which they might be refilled and resealed.

As time went on and more and more laser printers began to be used, the users began to tire of the $100.00 charge for a refill cartridge every time their laser printer needed toner ink. Entrepreneurs began to refill used toner cartridges with fresh toner and sell the recycled product at far below the cost of a new replacement product. The semi-automation of the recycling process is the next logical step in the progression. This invention semi-automates one important area of the toner cartridge recycling process.

One of the most difficult and perplexing tasks involved in recycling toner cartridges has been resealing the cartridge toner chamber after refilling so as to prevent messy spillage and leakage of the toner during shipping and handling. This is because the factory applied seal is made at a point of partial assembly of the cartridge, whereas the required points of sealing are effectively covered and hidden when the cartridge is fully assembled. One such commonly occurring, but difficult, task involves a situation where an adhesive sealing tape must be applied across a long, relatively wide toner opening wherein the only access to that opening is a tiny slot originally designed to be just large enough to remove the thin strip of adhesive tape. This invention fills an important need by providing a tool for admirably performing that task with ease and dispatch.

It is to be understood from the outset that the scope of this invention is not limited to these fields or to the specific examples of potential uses presented hereinafter.

2. Description of the Prior Art

Several United States Patents have been granted which strive for solution of the above mentioned problems or otherwise show some features similar to those of this invention.

U.S. Pat. No. 4,279,065 issued to Sernevi on Jul. 21, 1981, shows a pusher rod 17 for inserting foam rubber strips into the ends of tubing members so as to form semipermanent plugs. The disclosure is considered pertinent to the apparatus of the instant invention only in so much as it teaches the insertion by pushing of a flaccid material into a relatively confined opening.

U.S. Pat. No. 5,142,845 issued to Maclauchlan on Sep. 1, 1992, shows a pusher 20 for inserting end caps into cigarette boxes. Again the only pertinence to the instant invention is the use of a pusher to insert an object into a relatively inaccessible location.

In U.S. Pat. No. 4,599,851 issued to Williams on Jul. 15, 1986 there is shown a method of filling a dry toner cartridge. The relevance of this patent to the instant invention is in its discussion of grasping the tail 30 of the heat sealed tape and pulling it to break the seal between the tape and the flange 18, thus allowing the toner particles to discharge into the hopper.

None of the above prior art, taken singly or in combination, anticipates or makes obvious the invention claimed herein.

SUMMARY OF THE INVENTION

The present invention consists of a base that includes a workholder means to receive and prevent significant axial movement of a toner cartridge. There is also a guide slot mount and a swivel arm mount attached to the base. The toner cartridge is held by the receiving means and the adhesive strip seal is wrapped over the insertion tongue. The tongue guide shoe and the tongue itself are fit into two guide slots and the swivel arms are engaged with a protrusion on the tongue guide shoe. Movement of the arm thus forces the insertion tongue into the thin slit in the side of the toner cartridge and, when the movement of the arm or arms is reversed, the adhesive strip seal is left in place.

Accordingly, it is a principal object of the invention to provide a toner cartridge recharging tool to semi-automate the process of recharging an exhausted toner cartridge.

It is another object of the invention to provide a toner cartridge recharging tool where the wrapping of the adhesive strip seal about the insertion tongue is aided by having the tongue removable from the rest of the device.

It is a further object of the invention to provide a toner cartridge recharging tool where the insertion tongue is attached to a tongue guide shoe that has an adjustable stop means thereon to limit the travel of the insertion tongue.

Still another object of the invention is to provide a toner cartridge recharging tool where the insertion tongue and tongue guide shoe are each engaged, during the insertion process, by separate guide slots.

It is still yet another object of the invention to provide a toner cartridge recharging tool where the insertion tongue has a slight downward bend or bow to ensure that it contacts the guide shelf on the toner cartridge and thus easily slips into the thin slit therein.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
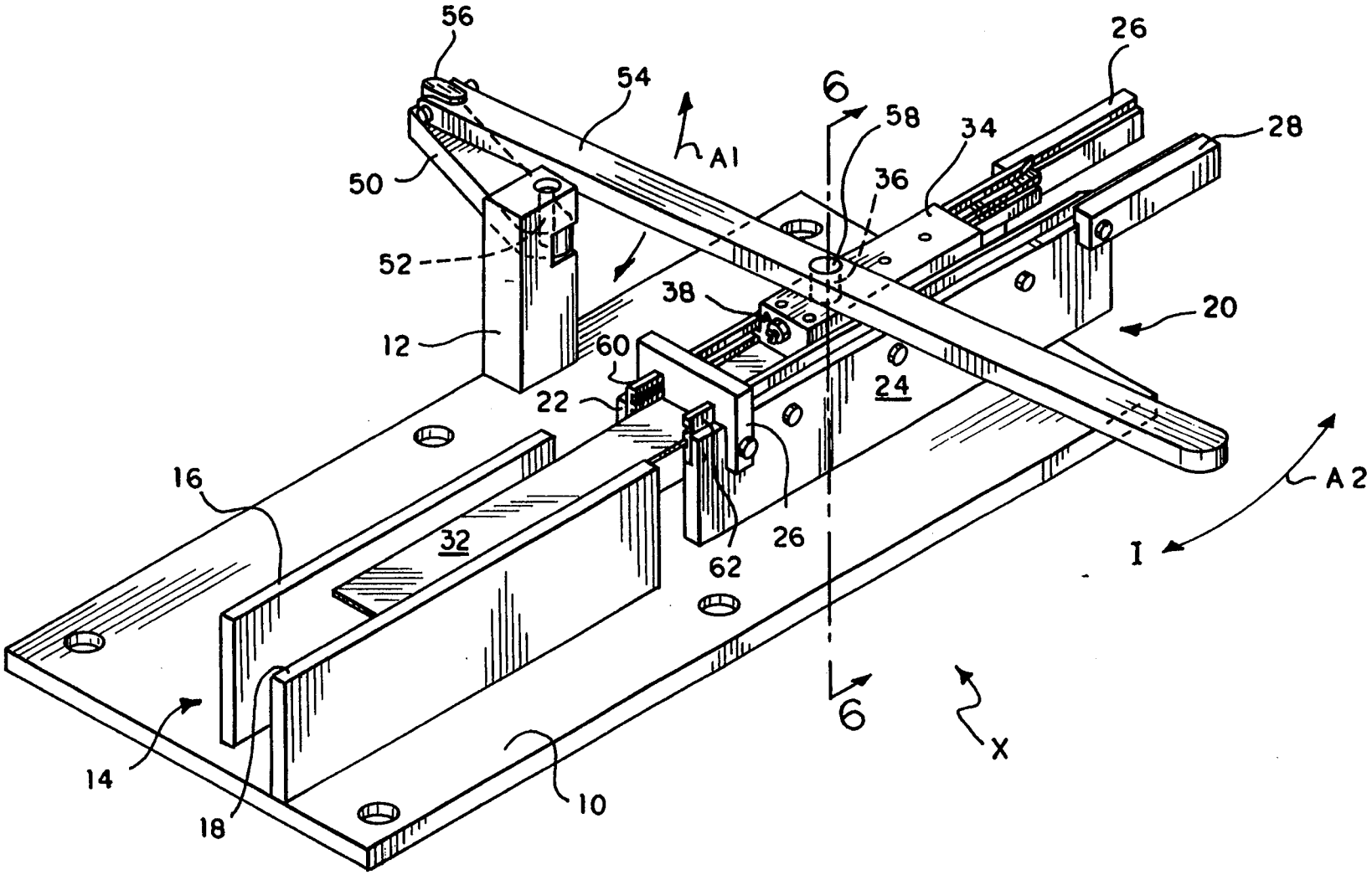
FIG. 1 is a perspective view of the toner cartridge recharging tool showing the second arm engaged with the tongue guide shoe and the insertion tongue partially extended into the workholder area.
Figure 2:
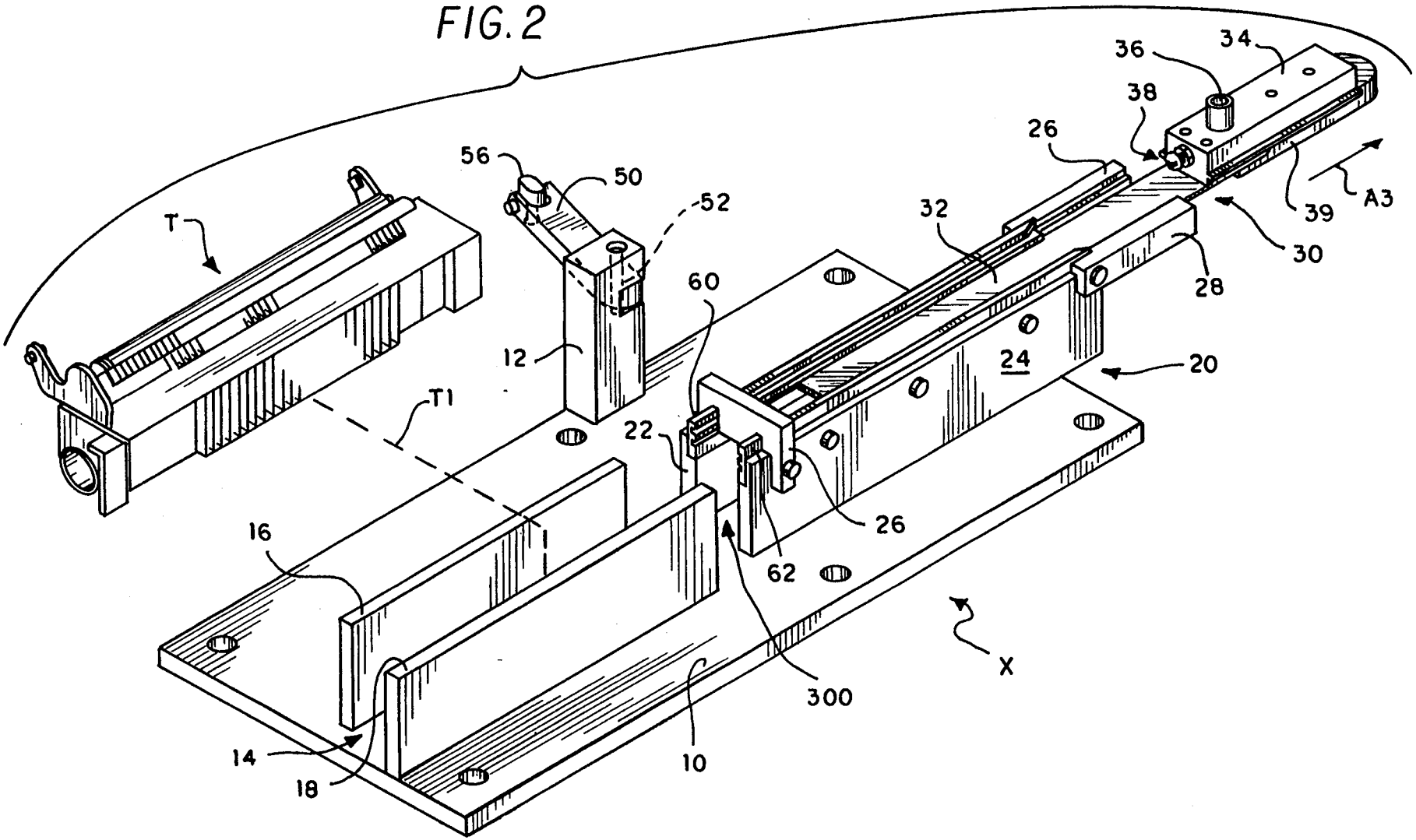
FIG. 2 is a perspective view of the present invention showing, in dotted lines, the path of the toner cartridge when inserted in the workpiece holder.

Referring now to FIGS. 1 and 2, the toner cartridge recharging tool X comprises a base 10, a swivel arm mount 12, workpiece holder 14 that comprises two workpiece holder members 16, 18 adapted to receive a toner cartridge T as shown by broken line T1 and hold it in place. The guide slot mount 20 has two guide slot mount members 22, 24 that define an insertion member travel area 300, shown in FIGS. 1 and 6, and mounted transversely therein is a travel stop 26. The guide slot mount members 22, 24 have attached to them a pair of L-shaped feed guides 26, 28.

Figure 3:
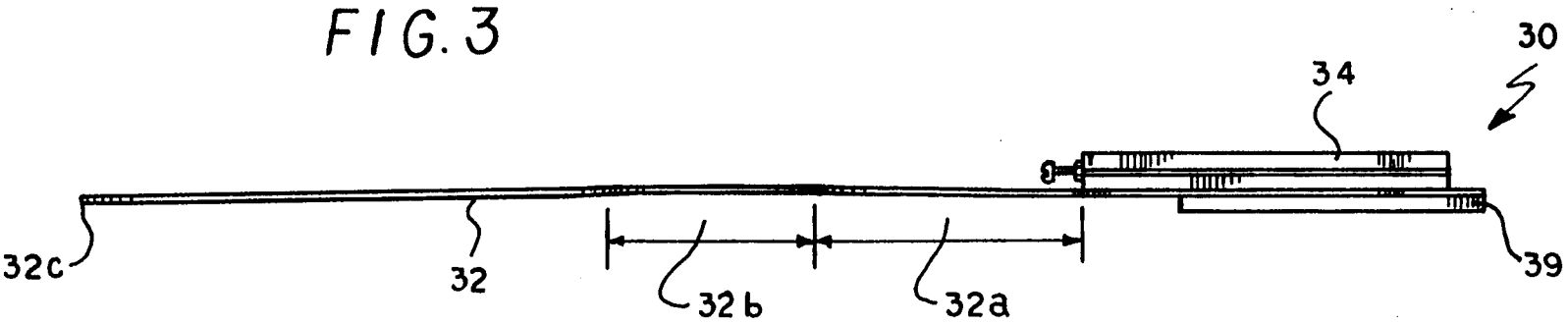
FIG. 3 is a side view of the insertion tongue showing the slight bend or bow therein.

Turning to FIGS. 1, 2, 3, and 8, the insertion member 30 is shown to have an insertion tongue 32, a tongue guide shoe 34 that includes a protrusion 36 and an adjustable stop means 38. The adjustable stop means is, in the preferred embodiment of the invention, a threaded screw 150 with a locking nut 160, both shown in FIG. 8, that can be tightened to hold the threaded screw 150 at a predetermined distance from the tongue guide shoe 34. The insertion member 30 also has a tongue guide lower member 39 located on the opposite side of the insertion tongue 32. In FIG. 3 it is seen that the insertion tongue 32 has a bow or bend therein. In interval 32*a* the insertion tongue 32 is oriented at a small angle upwards. In interval 32*b* the insertion tongue 32 is oriented at a slight angle downwards thus the insertion tip 32*c* of the insertion tongue 32 tends generally downwards in relation to the plane described by insertion guide shoe 34.

Figure 6:
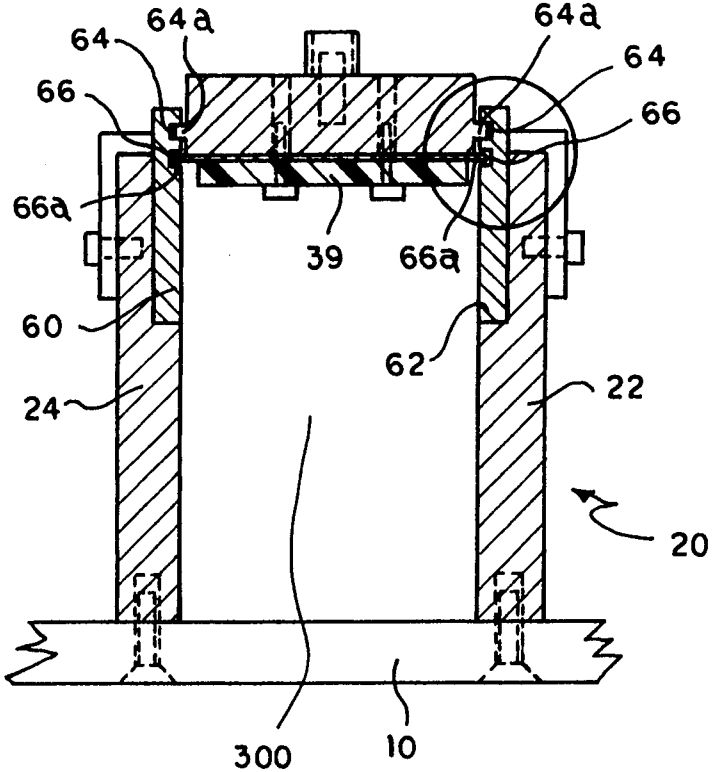
FIG. 6 is a partial cutaway view taken along line 6—6 in FIG. 1 showing the hardened steel guide slot insert which comprises the upper and lower guide slot.
Figure 7:
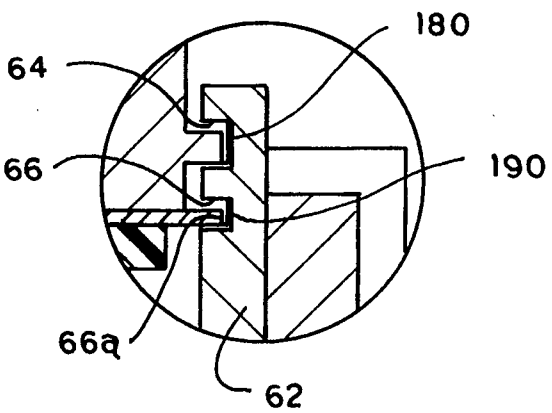
FIG. 7 is a detail view of the guide slot insert, upper and lower guide slots, and the lubrication and wear protection means disposed therein.

The swivel arm mount 12 has a first arm 50 attached by swivel hinge 52. A second arm 54 is attached to the first arm 50 by a second universal type hinge 56 where the two pivot axes are orthogonal. The second arm also has an aperture 58, shown in FIG. 1, that is configured to receive the protrusion 36 on the tongue guide shoe 34 thus allowing the user to slide the insertion member 30 along within the guide slot mount members 22, :24. The insertion member 30 is engaged between the guide slot mount members 22, 24 by the guide slot carrying members 60, 62, This is best seen in FIGS. 6 and 7. The guide slot carrying members 60, 62 are preferably made of a hardened steel and each contain an upper slot 64 and a lower slot 66. The inner surfaces of the guide slots are coated at 180 and 190 with a teflon or silicon low friction bearing surface. The upper slots 64 engage with fingers 64*a* extending dorsally of the tongue guide shoe 34 and the lower slots 66 engage the dorsal edges 66*a* of the insertion tongue 32.

Figure 8:
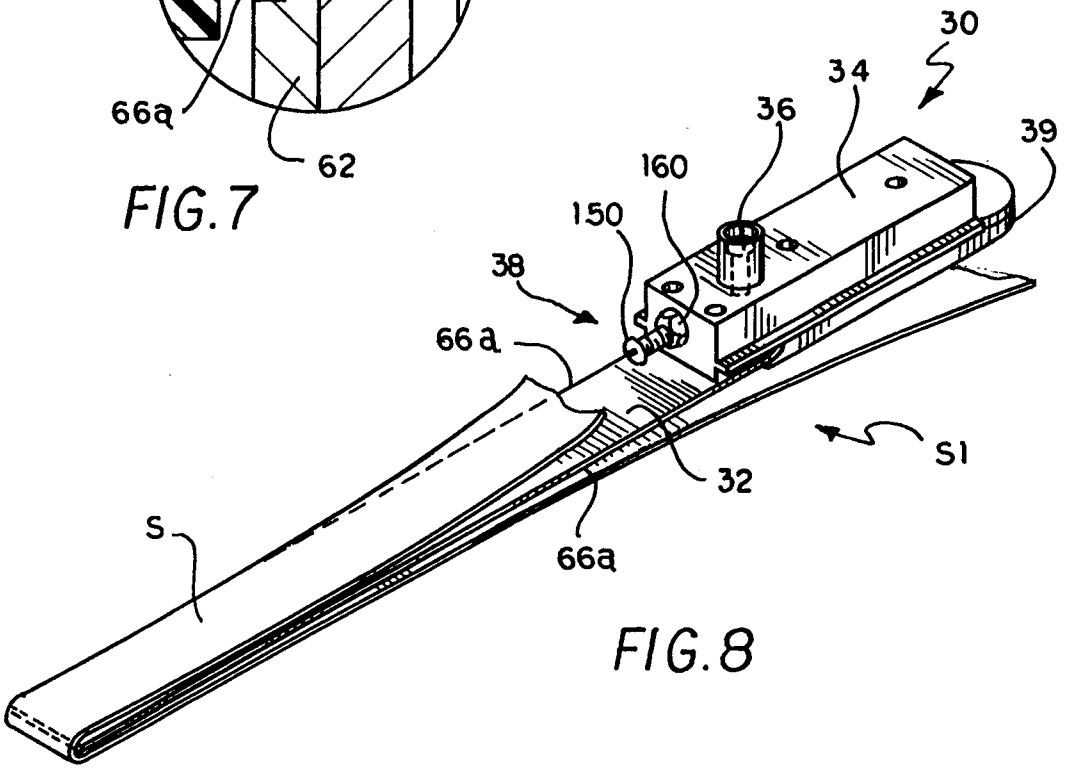
FIG. 8 is a detail view of the insertion member, comprising the insertion tongue, tongue guide shoe, and tongue guide lower member and showing the adhesive strip seal wrapped about the insertion tongue in the proper manner for use of the invention.

In use, the toner cartridge recharging tool X is readied by placing the toner cartridge T within the workpiece holder members 16, 18 to fix it in place. The ends of holder member 18 engage with shoulders 15 and 17 on the toner cartridge to prevent unwanted axial motion and back wall 19 of the toner cartridge abuts the inner face of holder member 16 to prevent unwanted lateral motion. The vertical position of the cartridge may be determined by contact of the toner cartridge with base 14 or by contact between the upper surfaces of members 16 and 18 upon corresponding horizontal ledges on the edges of the toner cartridge. The insertion member 30 is removed from the recharging tool X by sliding it in the direction indicated by arrow A3 in FIG. 2. The adhesive strip seal S, as shown in FIG. 8, is wrapped about the insertion tongue 32 at the insertion tip 32*c*, leaving a longer tail S1 extending proximate the grip end 80 of the insertion member 30. The insertion member 30 is then placed back into the recharging tool X by placing insertion tip 32*c*, and thus the insertion tongue 32, on the L-shaped feed guides 26, 28 and allowing the feed guides 26, 28, while the insertion member 30 is slid opposite the direction indicated by arrow A3, to direct the dorsal edges 66*a* of the insertion tongue 32 into the lower slots 66 of the guide slot carrying members 60, 62. As the sliding movement is continued, eventually the extending dorsal fingers 64*a* will engage the upper slots 64 of the guide slot carrying members 60, 62. At this point, the first arm 50 and the second arm 54 are manipulated by means of the swivel hinge 52 and the universal type hinge 56, the movement of the latter being illustrated in FIG. 1 by arrows A1 and A2. The aperture 58 in the second arm 54 is brought into alignment with, and receives, protrusion 36 on the tongue guide shoe 34. Then the second arm 54 is now manipulated in the direction indicated I at arrow A2. The insertion tongue 32, carrying the adhesive strip seal S with it, enters the thin slot 100 on the side of the toner cartridge T. As discussed above, this process is aided by the small angle orientation changes at intervals 32*a*, 32*b* that tend to keep the insertion tip 32*c* tended downwards thus keeping the insertion tip 32*c* adjacent to the guide shelf 102 that is integral with the toner cartridge T. The second arm 54 is moved in the direction indicated I at arrow A2 until the adjustable stop means 38, more specifically the head of the threaded screw 150, butts against the travel stop 26. The movement of the second arm is then reversed. The adhesive strip seal S is left within the toner cartridge T while the insertion tongue 32 retracts, and the tail S1 is left protruding from the thin slot 100. The toner cartridge T is now ready to be refilled. When the user wishes to use the recharged cartridge, pulling the tail S1 brings the toner reservoir (not shown) and the transfer drum D into communication.

Figure 5:
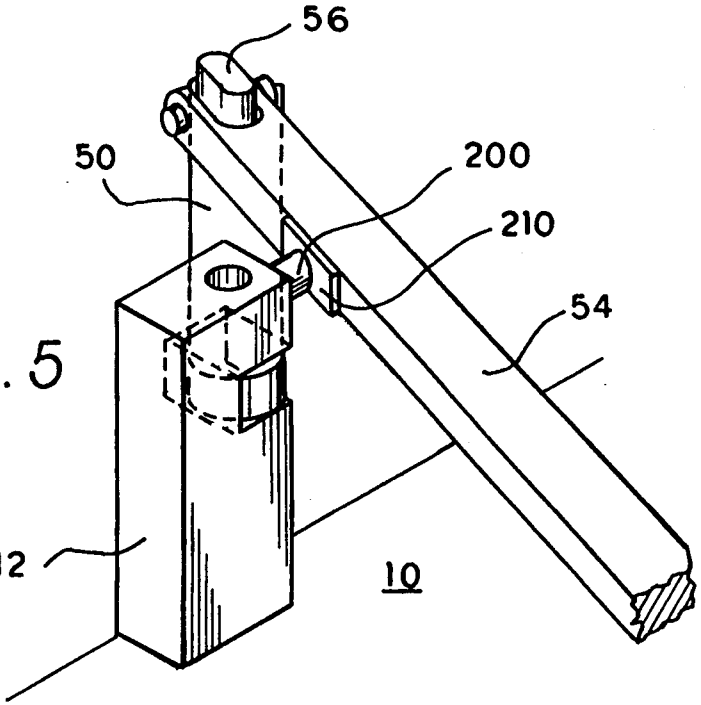
FIG. 5 is a detail view of the swing arm mount and the first and second swing arms showing the second embodiment of the invention wherein the adjustable stop means is located on the mount and second arm.
Figure 4:
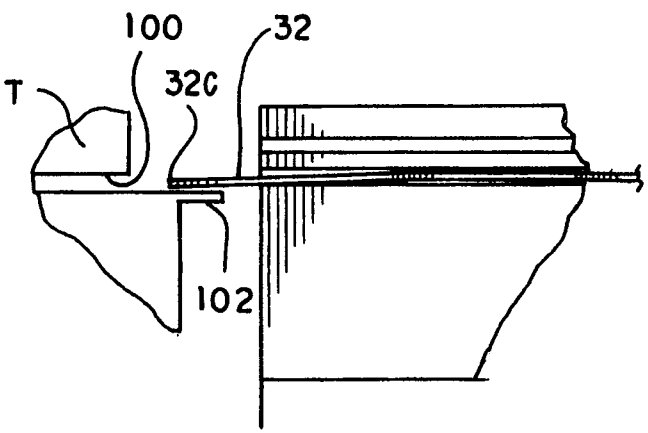
FIG. 4 is a partial side view of the insertion tongue projecting from the lower guide slot and, by virtue of the slight bow or bend, being aligned with the thin slot in the side of the toner cartridge, this alignment being aided by the guide shelf integral to the cartridge.

In a second embodiment of the invention, shown in FIG. 5, The travel stop 26 and the adjustable stop means 38 are replaced by an adjustable protrusion 200, similar to the threaded screw and locking nut discussed above. This adjustable protrusion is located on the swivel arm mount 12. There is a plate 210 on the second arm 54 located so as to engage the adjustable protrusion 200 when the insertion tongue 32 has progressed sufficiently far enough into the toner cartridge T.

It is to be understood that the present invention is not limited to the sole embodiments described above, but encompasses any and all embodiments within the scope of the following claims.

I claim:

1. A toner cartridge recharging tool comprising:

a generally planar base including work holder means for holding a toner cartridge;

insertion means for inserting an adhesive strip into a slot in the toner cartridge; said insertion means comprises at least:

a guide element;

a removable insertion member engageable with said guide element and including an insertion tongue having an insertion tip and two dorsal edges, and a tongue guide shoe attached to said insertion tongue and having a pair of longitudinal dorsal fins engageable with and slidable in said guide element;

an operating element for moving said insertion means through an insertion member travel area;

stop means for adjustably limiting the movement of said insertion means.

2. A tool as in claim 1, wherein said insertion tongue is slightly bent downwardly so as to engage the slot in the toner cartridge.

3. A tool as in claim 1, wherein said stop means further comprises:

travel stop means located on a guide slot mount, and adjustable stop means located on said tongue guide shoe.

4. A tool as in claim 1, wherein said guide element further comprises:

a guide slot mount attached to said base;

replaceable guide slot carrying members located at a periphery of the insertion member travel area, said guide slot carrying members having a upper slot and a lower slot disposed one above the other; wherein said lower slots receive said dorsal edges of said insertion tongue and said upper slots receive said dorsal fins of said tongue guided shoe.

5. A tool as in claim 4, wherein said replaceable guide slot carrying members are formed with differently positioned said upper slots and said lower slots so as to accommodate toner cartridges of differing dimensions.

6. A tool as in claim 1, wherein said operating element further comprises:

a swivel arm mount attached to said base;

a first arm pivotally connected to said mount and swinging about said swivel arm mount;

a second arm connected at one end to said first arm with a universal joint, said second arm also having an aperture intermediate its length which loosely engages a protrusion on said tongue guide shoe for translating said shoe and its attached insertion tongue.

7. A tool as in claim 6, wherein said stop means comprises:

travel stop means located on said first arm, and adjustable stop means located on said swivel arm mount.

8. A toner cartridge recharging tool comprising:

a generally flat base including work holder means for holding a toner cartridge;

a guide slot mount attached to said base and defining an insertion member travel area;

guide slot carrying members located at a periphery of said insertion member travel area, said guide slot carrying members having an upper slot and a lower slot disposed one above the other;

a travel stop located on said guide slot mount;

a swivel arm mount attached to said base having at least:

a first arm connected thereto and free to travel about said swivel arm mount, a second arm connected to said first arm with a universal joint, said second arm having an aperture defined therein;

a removable insertion member engageable within the insertion member travel area comprising at least:

an insertion tongue having an insertion tip and two dorsal edges, said dorsal edges adapted to be received within said lower slots in said guide slot carrying members and being configured to receive an adhesive strip, a tongue guide shoe having a pair of longitudinal dorsal fingers adapted to be received in said upper slots in said guide slot carrying members and further including an adjustable stop and a protrusion adapted to be received in said aperture defined in said second arm, whereby the adhesive strip is wrapped about said insertion tip and said insertion member is placed in the insertion member travel area, said dorsal edges of said insertion tongue being engaged by said lower slots in said guide slot carrying members, said longitudinal dorsal fingers on said tongue guide shoe being engaged by said upper slots in said guide slot carrying member, and said aperture defined on said second arm is aligned with said protrusion on said tongue guide shoe to engage said protrusion, said insertion member is carried by said upper slots and lower slots until said adjustable stop means abuts said travel stop thus inserting the adhesive strip in a toner cartridge.

* * * * *